US005604061A

United States Patent [19]

Sekido et al.

[11] Patent Number: 5,604,061

[45] Date of Patent: Feb. 18, 1997

[54] ELECTROPHOTOGRAPHIC PHOTOSENSITIVE MEMBER, PROCESS CARTRIDGE INCLUDING SAME AND ELECTROPHOTOGRAPHIC APPARATUS

[75] Inventors: Kunihiko Sekido; Hajime Miyazaki; Yoshio Kashizaki, all of Yokohama; Akihiro Senoo, Tokyo, all of Japan

[73] Assignee: Canon Kabushiki Kaisha, Tokyo, Japan

[21] Appl. No.: 577,817

[22] Filed: Dec. 22, 1995

[30] Foreign Application Priority Data

Dec. 28, 1994 [JP] Japan ..... 6-327932

[51] Int. Cl.[6] ..... G03G 5/14; G03G 15/22

[52] U.S. Cl. ..... 430/58; 430/60; 430/62; 430/64; 399/116

[58] Field of Search ..... 430/58, 60, 62, 430/64; 355/211

[56] References Cited

U.S. PATENT DOCUMENTS

| | | | |
|---|---|---|---|
| 5,075,189 | 12/1991 | Ichino et al. | 430/60 X |
| 5,173,385 | 12/1992 | Nozomi et al. | 430/64 X |
| 5,419,993 | 5/1995 | Sakakibara et al. | 430/62 |
| 5,464,718 | 12/1995 | Kashizaki et al. | 430/58 |
| 5,486,440 | 1/1996 | Kashizaki et al. | 430/62 |

FOREIGN PATENT DOCUMENTS

| | | |
|---|---|---|
| 48-047344 | 7/1973 | Japan . |
| 51-126149 | 8/1976 | Japan . |
| 52-020836 | 2/1977 | Japan . |
| 52-025638 | 2/1977 | Japan . |
| 53-089435 | 4/1978 | Japan . |
| 54-026738 | 1/1979 | Japan . |
| 55-103556 | 8/1980 | Japan . |
| 2115858 | 4/1990 | Japan . |

*Primary Examiner*—Roland Martin

*Attorney, Agent, or Firm*—Fitzpatrick, Cella, Harper & Scinto

[57] ABSTRACT

An electrophotographic photosensitive member is constituted by an electroconductive support, an intermediate layer disposed on the electroconductive support and a photosensitive layer disposed on the intermediate layer. The intermediate layer contains a copolymer having at least two species of a recurring unit having an amide acid structure and/or amide acid ester structure, thus resulting in good film-forming properties. The resultant photosensitive member is effective for providing a process cartridge and an electrophotographic apparatus respectively including the photosensitive member with a stable electric potential under any environmental condition to provide excellent images free from image defects for a long period.

8 Claims, 1 Drawing Sheet

ELECTROPHOTOGRAPHIC PHOTOSENSITIVE MEMBER, PROCESS CARTRIDGE INCLUDING SAME AND ELECTROPHOTOGRAPHIC APPARATUS

FIELD OF THE INVENTION AND RELATED ART

The present invention relates to an electrophotographic photosensitive member, particularly to an electrophotographic photosensitive member containing an intermediate layer comprising a copolymer having a specific structure.

The present invention also relates to a process cartridge and an electrophotographic apparatus respectively using the electrophotographic photosensitive member.

Electrophotographic photosensitive members generally have a photosensitive layer formed on an electroconductive support. Such a photosensitive layer is generally a very thin layer. Accordingly, the photosensitive layer has been liable to encountered a problem such that a thickness of the photosensitive layer becomes ununiform or irregular due to defects on the electroconductive support surface, such as scars or contaminant, in some cases. This tendency is particularly pronounced in the case of a so-called function separation-type photosensitive layer, which is predominantly used in recent years, comprising a very thin (e.g., about 0.5 μm-thick) charge generation layer and a charge transport layer.

If the thickness of a photosensitive layer is ununiform, irregularity in electric potential or photosensitivity is naturally caused to occur. As a result, the photosensitive layer is required to be formed in an appropriate thickness as uniform as possible.

The electrophotographic photosensitive member is required to have a stability of light-part potential and dark-part potential in repetitive use as an important characteristic. If these potentials are unstable, a resultant image is liable to have an ununiform image density and also to cause fogs therein.

In order to alleviate the above-mentioned disadvantages, there have been proposed various intermediate layers, disposed between the electroconductive support and the photosensitive layer, having functions of covering defects on the electroconductive support surface, improving adhesion between the electroconductive support and the photosensitive layer, and suppressing carrier injection from the electroconductive support into the photosensitive layer.

Heretofore, there have been proposed various resins for use in the intermediate layer, such as polyamide (as disclosed in Japanese Laid-Open Patent (JP-A) 48-47344 and JP-A 52-25638), polyester (JP-A 52-20836 and JP-A 54-26738), polyurethane (JP-A 53-89435 and JP-A 2-115858), quaternary ammonium-containing acrylic polymer (JP-A 51-126149) and casein (JP-A 55-103556).

However, electrophotographic photosensitive members using the resins as described above in an intermediate layer have been liable to change the electric resistance of the intermediate layer depending on changes in temperature and humidity, so that it has been difficult to prepare an electrophotographic photosensitive member having stable and excellent potential characteristics in an overall environmental condition ranging from low-temperature and low-humidity condition to high-temperature and high-humidity condition and capable of forming an excellent image.

More specifically, in case where the conventional electrophotographic photosensitive member as described above is used repetitively in low-temperature and low-humidity environmental condition in which the electrical resistance of an intermediate layer used is liable to be increased, the intermediate layer is liable to have a residual electric charge, thus resulting in an increase in a light-part potential and a residual potential. As a result, fogs have been caused to occur on copied images in normal development or a resultant image has possessed a poor image density in reversal development, thus failing to successively obtain an image having a prescribed image quality in some cases. On the other hand, in case where the conventional electrophotographic photosensitive member as described above is used repetitively in high temperature and high-humidity environmental condition in which the electrical resistance of an intermediate layer used is liable to be lowered, the intermediate layer is liable to have a lowered barrier function to accelerate carrier injection from the electroconductive support, thus resulting in an lowering in a dark-part potential. As a result, a resultant image has possessed a poor image density in normal development or black spot-like defects (black spots) or fogs have been caused to occur on copied images.

Further, even when the black spot-like defects on the resultant image are remedied by using an appropriate intermediate layer, the electrophotographic photosensitive member per se has caused a lowering in photosensitivity in many cases.

SUMMARY OF THE INVENTION

An object of the present invention is to provide an electrophotographic photosensitive member stably showing excellent potential properties and capable of successively forming and retaining a good image in an initial stage under an overall environmental condition including low-temperature and low-humidity condition to high-temperature and high-humidity condition.

Another object of the present invention is to provide an electrophotographic photosensitive member capable of providing a good image free from defects by disposing an intermediate layer containing a copolymer excellent in solubility resulting in good film-forming properties between an electroconductive support and a photosensitive layer.

A further object of the present invention is to provide a process cartridge and an electrophotographic apparatus respectively including the electrophotographic photosensitive member as described above.

According to the present invention, there is provided an electrophotographic photosensitive member, comprising: an electroconductive support, an intermediate layer disposed on the electroconductive support and a photosensitive layer disposed on the intermediate layer, wherein the intermediate layer comprises a copolymer having at least two species of a recurring unit having an amide acid structure or an amide acid ester structure.

According to the present invention, there is also provided a process cartridge and an electrophotographic apparatus respectively including the above-mentioned electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
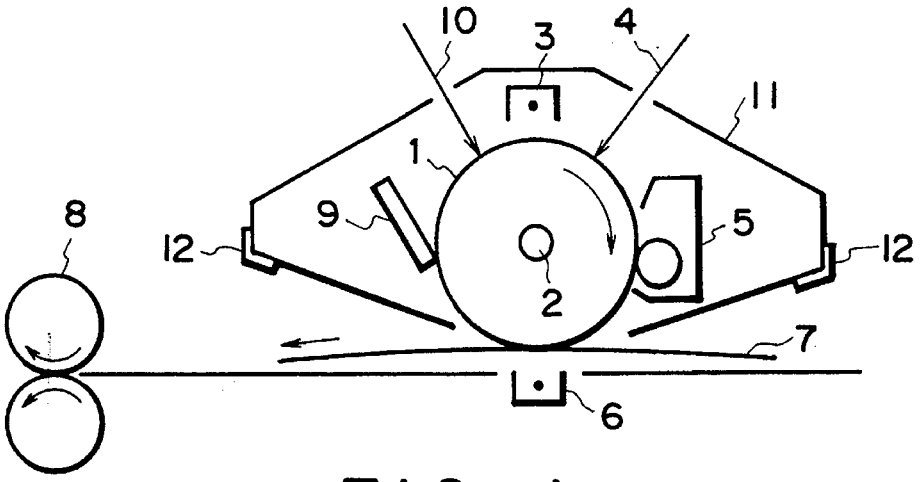
FIG. 1 is a schematic structural view of an embodiment of an electrophotographic apparatus including a process cartridge using the electrophotographic photosensitive member according to the present invention.

The electrophotographic photosensitive member according to the present invention is characterized by an intermediate layer comprising a copolymer having at least two species of an amide acid structure and/or an amide acid ester structure as a recurring unit of the copolymer.

The above recurring unit may be constituted by at least two species of an amide acid structure or by at least two species of an amide acid ester structure or by at least one species of an amide acid structure and at least one species of an amide acid ester structure.

The copolymer having such a recurring unit has a high solubility in organic solvent to improve its film-forming properties, thus providing a uniform intermediate layer to prevent irregularity in potential and sensitivity. As a result, good images free from image defects (e.g., black spots or fogs) can be obtained stably. Further, because of improved solubility, a low boiling point solvent, such as alcohols or ethers, can be used to provide a smooth intermediate layer without adversely affecting a lower layer thereof containing a resin.

The copolymer having the amide acid structure and/or amide acid ester structure may be generally synthesized by using a diamine component and a carboxylic acid component and/or a carboxylic acid component, such as carboxylic acid ester or carboxylic acid anhydride. In this instance, the diamine component and the carboxylic acid (ester) component may preferably be used in a molar ratio of 1:1 (in total). When two or more species of the diamine and/or carboxylic acid (ester) are used, respective diamines or respective carboxylic acids (or acid esters) may be used in any molar ratio, respectively, as long as a resultant diamine component and a resultant carboxylic acid (ester) component show a molar ratio of 1:1. Further, each of the diamine component and the carboxylic acid (ester) component may preferably contain at least 80 mole % of a predominant diamine component or a predominant carboxylic acid (ester) component, respectively.

The amide acid structure and amide acid ester structure may preferably have the following formula (1):

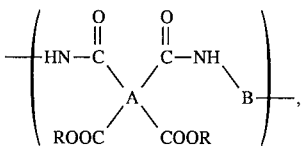

(1)

wherein A is a tetravalent organic group, B is a divalent organic group, and R is hydrogen atom (for providing the amide acid structure) or alkyl group (for providing the amide acid ester structure).

In the above formula (1), the tetravalent organic group A may include a tetravalent group having at least one cyclic group.

Preferred examples of the tetravalent organic group A may include those having the structure shown below.

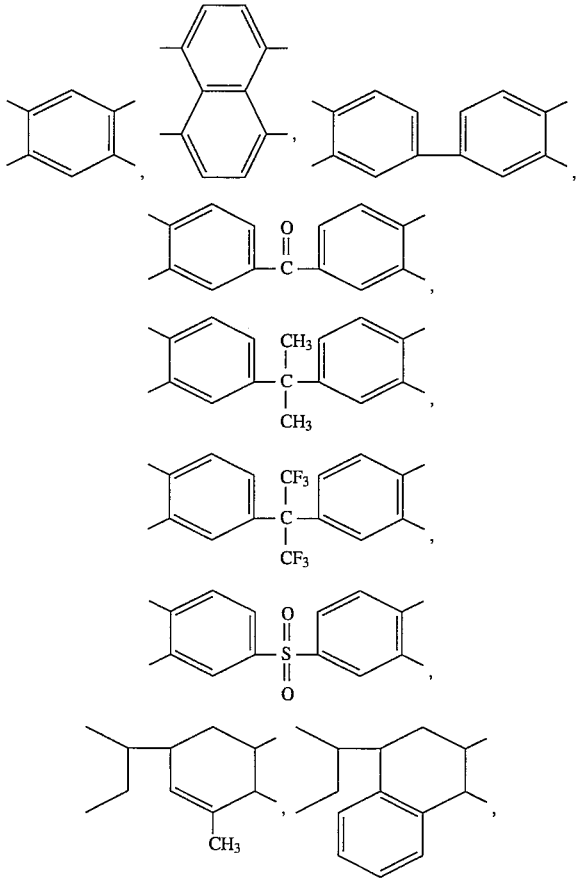

In the above formula (1), the divalent organic group B may include at least a saturated hydrocarbon group, an aromatic hydrocarbon group or a heterocyclic group and may preferably include at least one cyclic group.

Preferred examples of the divalent group B in the formula (1) may include those having the structures shown below.

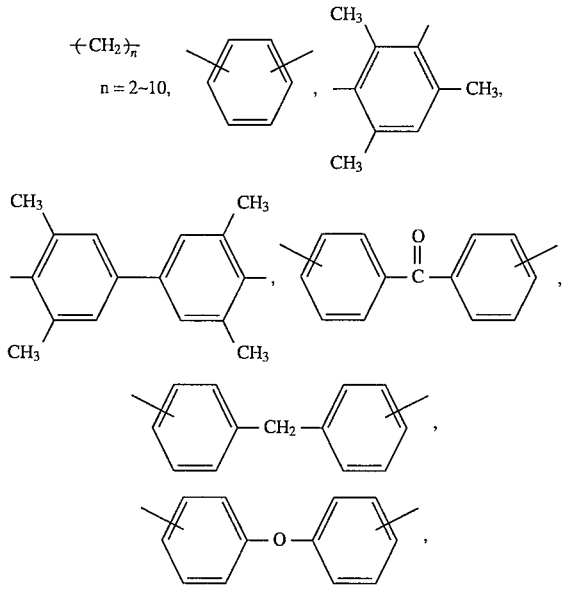

-continued

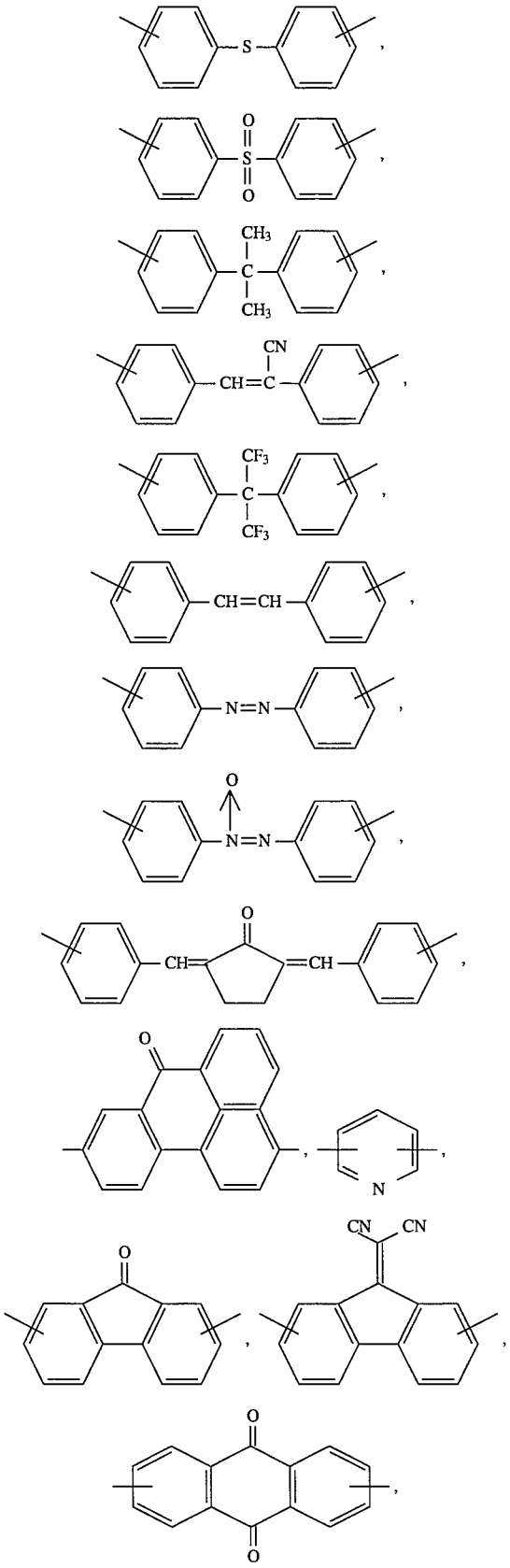

-continued

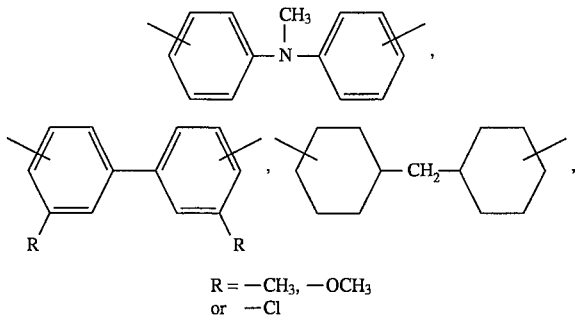

In the formula (1), preferred examples of R may include: hydrogen atom; and alkyl group, such as methyl, ethyl, n-propyl, iso-propyl, n-butyl, iso-butyl or tert-butyl.

The copolymer having the above-mentioned recurring unit (preferably represented by the formula (1)) used in the present invention may preferably have a number-average molecular weight (Mn) of 500–100,000, more preferably 10,000–50,000.

In some cases of the present invention, the copolymer has a recurring unit containing imide structure (e.g.,

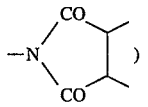

formed through a reaction in which amide portion of the amide acid structure or amide acid ester structure in the recurring unit is reacted with acid or acid ester portion to eliminate water or alcohol depending upon drying conditions in an ordinary drying step of a production process of an electrophotographic photosensitive member.

The copolymer used in the present invention may preferably contain the amide acid structure and/or amide acid ester structure (i.e., -COOH or -COOR' (R'=alkyl) in a proportion of 20–80 mole %, particularly 40–60 mole %, per the total of the amide acid structure, the amide acid ester structure and imide structure (e.g.,

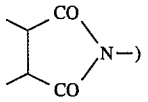

in the entire copolymer structure. This is presumably because the polyamide acid structure and/or the amide acid ester structure is effective in suppressing injection of hole from an electroconductive support and promoting electrolytic dissociation of a carrier generated by the action of a charge-generating material and injection of electron into an intermediate layer. Further, we presume that the polyimide structure has a densed and packed state, whereby the electrolytic dissociation of a carrier and injection and movement of electron is promoted and such a structure is little affected by moisture.

Hereinbelow, specific and non-exhaustive examples of the recurring unit of the copolymer used in the present invention are shown by indicating varying parts A, B and R and molar ratios of respective raw materials (such as, diamines, carboxylic acids and carboxylic acid derivatives) in parenthesis. However, the recurring unit of the copolymer applicable to the present invention are not limited thereto.

Formula (1):
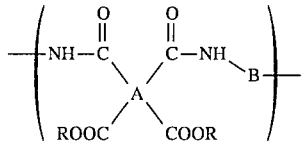
| Ex. Comp. No. | A | B |
|---|---|---|
| 1 | 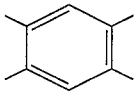 (1) R = H 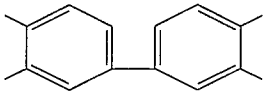 (1) R = H | 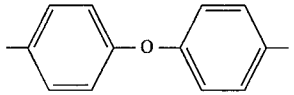 (2) |
| 2 | 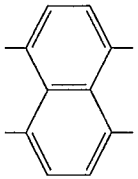 (1) R = H 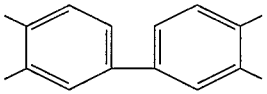 (1) R = H | 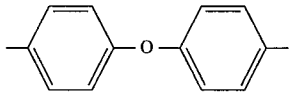 (2) |
| 3 | 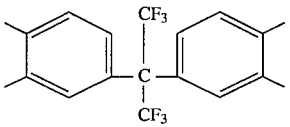 (1) R = H 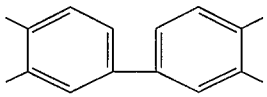 (1) R = H | 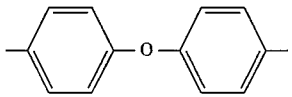 (2) |
| 4 | 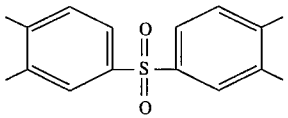 (1) R = H 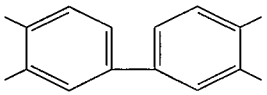 (1) R = H | 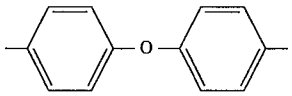 (2) |

-continued
Formula (1):
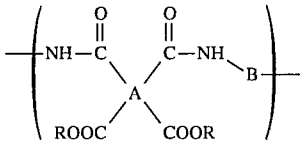
| Ex. Comp. No. | A | B |
|---|---|---|
| 5 | 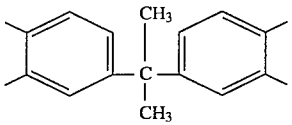 (1) R = $CH_3$ 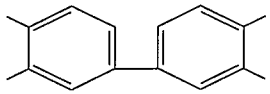 (1) R = $CH_3$ | 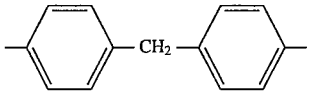 (2) |
| 6 | 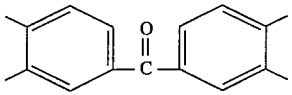 (1) R = iso-$C_3H_7$ 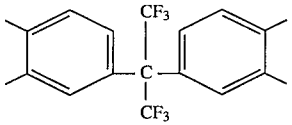 (1) R = H | 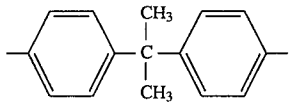 (2) |
| 7 | 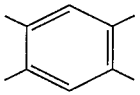 (1) R = $C_2H_5$ 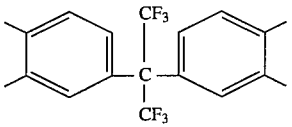 (1) R = $C_2H_5$ | 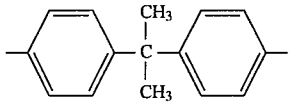 (2) |
| 8 | 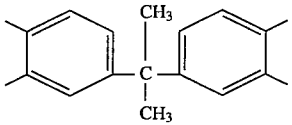 (1) R = iso-$C_3H_7$ 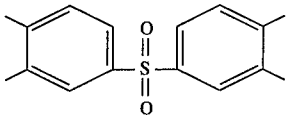 (1) R = H | 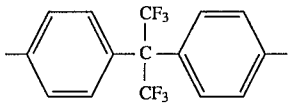 (2) |

-continued
Formula (1):
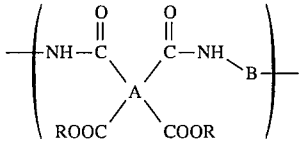
| Ex. Comp. No. | A | B |
|---|---|---|
| 9 | 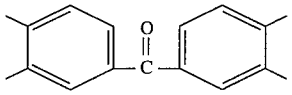 (1) R = iso-$C_3H_7$ 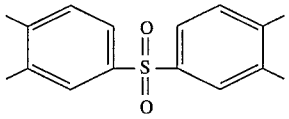 (1) R = H | 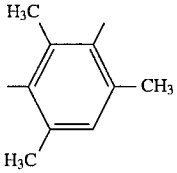 (2) |
| 10 | 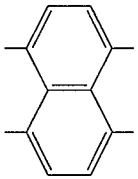 (1) R = H 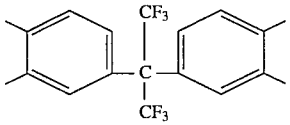 (1) R = H | 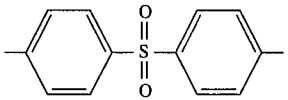 (2) |
| 11 | 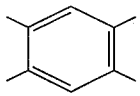 (1) R = $C_2H_5$ 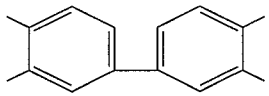 (1) R = $C_2H_5$ 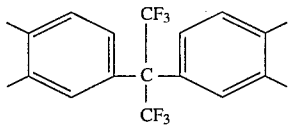 (1) R = H | 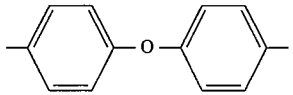 (3) |
| 12 | 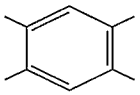 (1) R = $C_2H_5$ 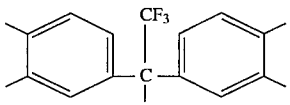 (1) R = H 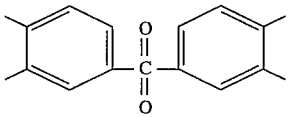 (1) R = H | 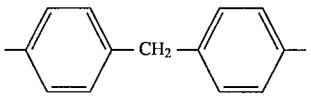 (3) |

-continued
Formula (1):
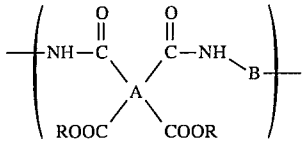
| Ex. Comp. No. | A | B |
|---|---|---|
| 13 | 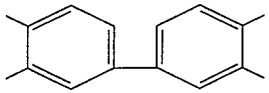 (2) R = H | 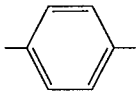 (1) 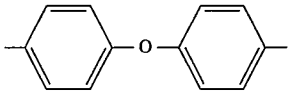 (1) |
| 14 | 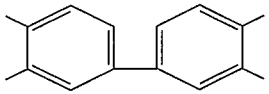 (2) R = H | 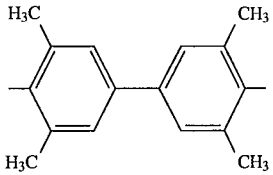 (1) 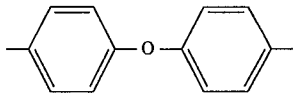 (1) |
| 15 | 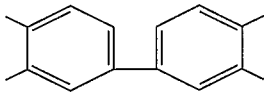 (2) R = H | 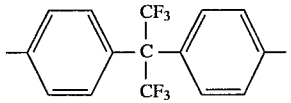 (1) 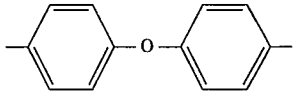 (1) |
| 16 | 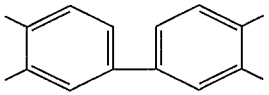 (2) R = $CH_3$ | 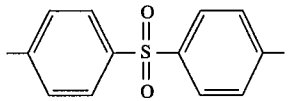 (1) 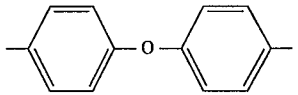 (1) |
| 17 | 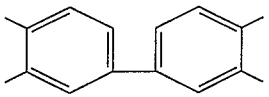 (2) R = H | 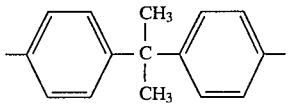 (1) 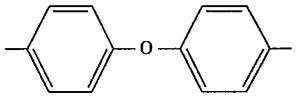 (1) |

-continued
Formula (1):
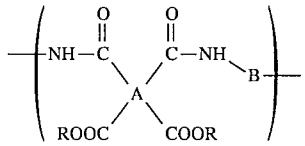
| Ex. Comp. No. | A | B |
|---|---|---|
| 18 | 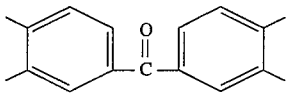 (2) R = tert-$C_4H_9$ | 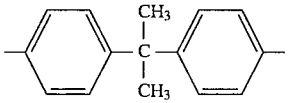 (1) 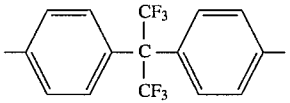 (1) |
| 19 | 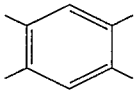 (2) R = H | 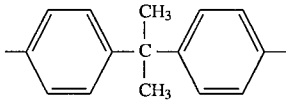 (1) 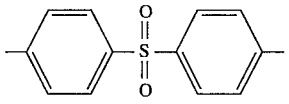 (1) |
| 20 | 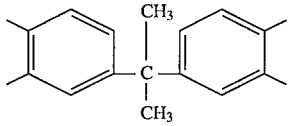 (2) R = $CH_3$ | 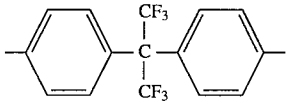 (1) 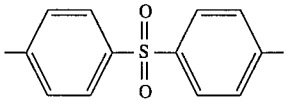 (1) |
| 21 | 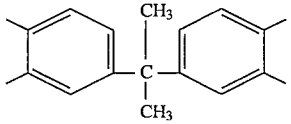 (2) R = $CH_3$ | 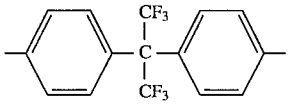 (1) 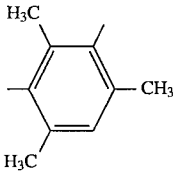 (1) |

-continued
Formula (1):
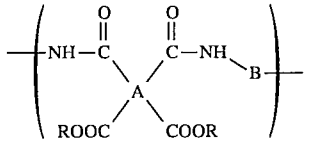
| Ex. Comp. No. | A | B |
|---|---|---|
| 22 | 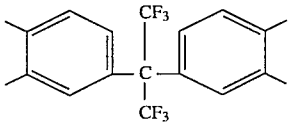 (2) R = H | 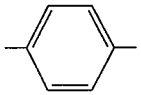 (1) 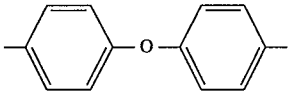 (1) |
| 23 | 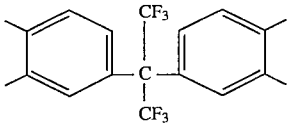 (2) R = H | 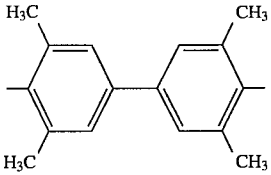 (1) 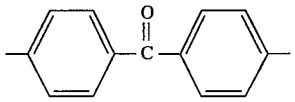 (1) |
| 24 | 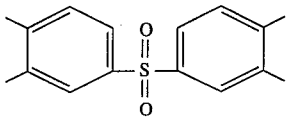 (2) R = H | 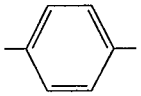 (1) 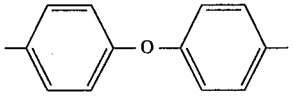 (1) |
| 25 | 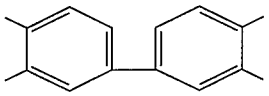 (3) R = H | 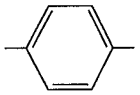 (1) 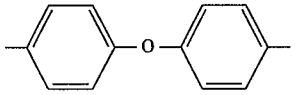 (1) 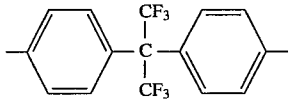 (1) |

-continued
Formula (1):
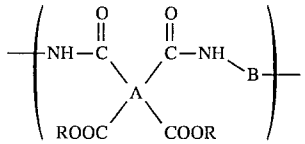
| Ex. Comp. No. | A | B |
|---|---|---|
| 26 | 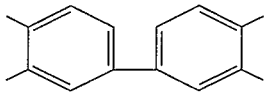 (3) R = H | 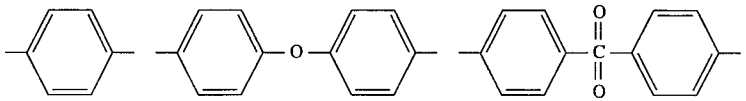 (1) (1) (1) |
| 27 | 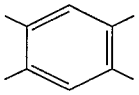 (1) R = H 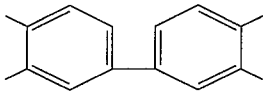 (1) R = H | 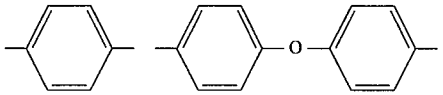 (1) (1) |
| 28 | 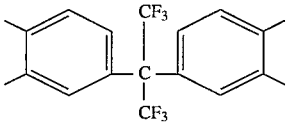 (1) R = H 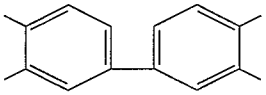 (1) R = $C_2H_5$ | 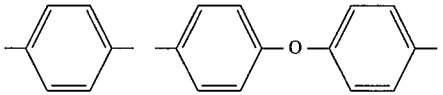 (1) (1) |
| 29 | 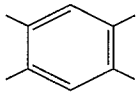 (1) R = H 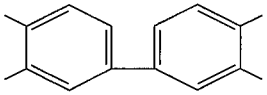 (1) R = $C_2H_5$ | 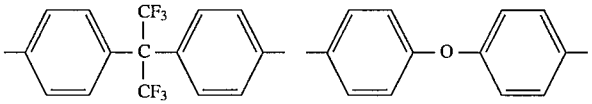 (1) (1) |
| 30 | 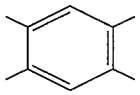 (1) R = H 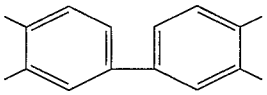 (1) R = $C_2H_5$ | 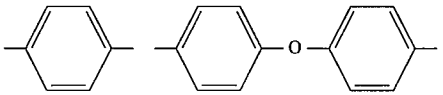 (2) (2) |

-continued
Formula (1):
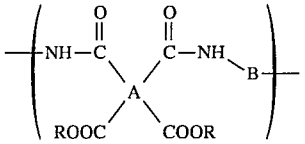
| Ex. Comp. No. | A | B |
|---|---|---|
| | 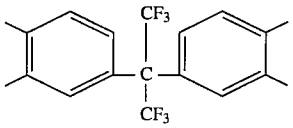 (2) R = H | |
| 31 | 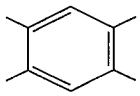 (2) R = H 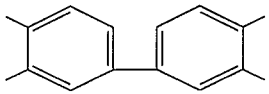 (2) R = $CH_3$ | 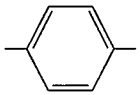 (1) 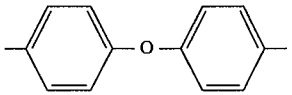 (1) 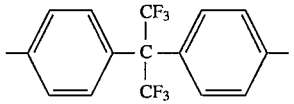 (2) |
| 32 | 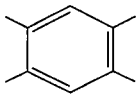 (1) R = H 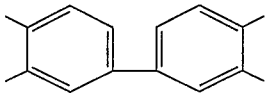 (1) R = iso-$C_3H_7$ 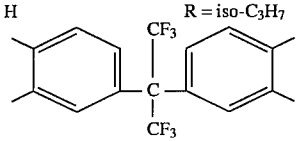 (1) R = H | 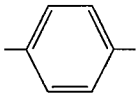 (1) 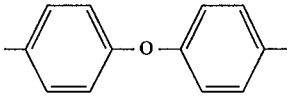 (1) 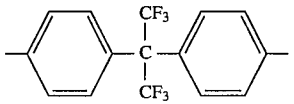 (1) |

The copolymer used in the present invention may generally be synthesized through ring-opening polyaddition reaction in which a tetracarboxylic dianhydride or a half-esterified dicarboxylic acid derivative thereof is reacted with a diamine in an organic polar solvent. Examples of such an organic polar solvent may include: amide-type solvent such as N,N-dimethylacetoamide, N,N-dimethylformamide or N-methylpyrrolidone; phenol-type solvent such as cresol or chlorophenol; ether-type solvent such as diethylene glycol dimethyl ether; and a mixture solvent thereof. It is also possible to effect the reaction by adding an appropriate amount (at most 5 wt. %) of water to the organic polar solvent as mentioned above in order to control a molecular weight of a resultant copolymer. The reaction temperature in the above reaction may preferably be controlled at 20°–120° C., particularly 20°–40° C.

The copolymer (partially) having the imide structure (e.g.,

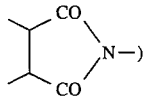

described above may be formed by heat-treating the above-prepared copolymer at an appropriate temperature, preferably at 50°–400° C., for a prescribed time, preferably for 5 minutes to 4 hours. The treating temperature and treating time largely affect a ratio (mole %) of the imide structure to the total of the imide structure and the amide acid structure and/or amide acid ester structure (i.e., -COOH and/or -COOR' (R'=alkyl)) in the entire copolymer structure (herein, referred to as "imide degree").

The imide degree can be determined based on a ratio of an absorbance at 1500 $cm^{-1}$ with respect to phenylene group to an absorbance at 1740–1780 $cm^{-1}$ with respect to imido group obtained by using infrared absorption spectrum measurement (or infrared (absorption) spectrophotometry) of a sample copolymer or based on an amount of proton present in carboxyl group and carboxyl ester (or carboxylate) group of a sample copolymer obtained by using $H^1$-NMR (nuclear magnetic resonance) spectrum.

Synthesis Example

In a 500 ml-four necked flask, 6.66 g (0.015M) of 4,4'-(hexafluoroisopropyridene)diphthalic anhydride, 4.41 g (0.015M) of 4,4'-biphthalic anhydride and 150 g of N,N-dimethylacetoamide were placed while supplying therein dry nitrogen gas. Then, the solution was vigorously stirred at 25° C., followed by addition of 6.01 g (0.030M) of 4,4'-diaminodiphenyl ether in 1–2 minutes. The mixture was further stirred for 3 hours while continuously supplying dry nitrogen gas, whereby a viscous pale yellow liquid (reaction mixture) was obtained. To the reaction mixture, 3 liters of a mixture solvent (water/methanol=1/1) was added while vigorously stirring the reaction mixture thereby to precipitate a polyamic acid copolymer. The polyamic acid copolymer was recovered by filtration and dried to obtain 9.80 g of a copolymer having a recurring unit of the formula (1) (Example Compound No. 3).

Other copolymers usable in the present invention can be prepared in the same manner as in the copolymer (Ex. Comp. No. 3) case.

The intermediate layer used in the present invention may be composed of a single layer or a plurality of layers in which at least one layer thereof contains the copolymer having the recurring unit as described above. In case where the intermediate layer is composed of the plurality of layers, each of the layers may contain another resin different from the above-mentioned copolymer. Examples of such another resin may include polyamide, polyester and phenolic resin.

In the present invention, the intermediate layer may contain another resin as described above, an additive and an electroconductive substance, as desired, in an amount sufficient to achieve the effect of the present invention. Examples of the additive may include an acceptor such as 2,5,7-trinitrofluorenone or benzoquinone. Examples of the electroconductive substance may include: metal powder (e.g., those of aluminum, copper, nickel and silver); metallic short fiber; carbon fiber; and electroconductive powder such as carbon black, titanium black, graphite, metal oxide and metal sulfide (e.g., antimony oxide, indium oxide, tin oxide, titanium oxide, zinc oxide, potassium titanate, barium titanate, magnesium titanate, zinc sulfide, copper sulfide, magnesium oxide and aluminum oxide), these metal oxides and metal sulfides surface-treated with an electroconductive material, silane coupling agent or titanium coupling agent, and these metal oxides and metal sulfide which have been subjected to reduction treatment.

The intermediate layer may be formed by dispersing or dissolving the above-described copolymer in an appropriate solvent, applying the resultant coating liquid onto the electroconductive support by using a known coating method and then drying the coating.

The intermediate layer used in the present invention may preferably contain the copolymer having the recurring unit as described above in a proportion of 10–90 wt. %, particularly 30–70 wt. %, per the entire weight of the intermediate layer. The intermediate layer may be set to have an appropriate thickness in view of electrophotographic properties and defects on the electroconductive support but may preferably have a thickness of 0.1–50 μm, particularly 0.5–30 μm.

The photosensitive layer used in the present invention is formed on the intermediate layer disposed on the electroconductive support. The photosensitive layer may be roughly classified into a single layer-type photosensitive layer wherein a charge-generating material and a charge-transporting material are contained in a single layer and a lamination layer-type photosensitive layer comprising a charge generation layer containing a charge-generating material and a charge transport layer containing a charge-transporting material. The lamination layer-type photosensitive layer may further be classified into one comprising a charge generation layer and a charge transport layer in this order (or in sequence) disposed on the electroconductive support and one comprising a charge transport layer and a charge generation layer in this order disposed on the electroconductive support. In the present invention, the electrophotographic photosensitive member may preferably be constituted by disposing an electroconductive support, an intermediate layer, a charge generation layer and a charge transport layer in this order.

Examples of the charge-generating material constituting the charge generation layer may include: azo pigments of monoazo-type, bisazo-type, trisazo-type, etc.; phthalocyanine pigments such as metallophthalocyanine and non-metallophthalocyanine; indigo pigments such as indigo and thioindigo; polycyclic quinone pigments such as anthraquinone and pyrenequinone; perylene pigments such as perylenic anhydride and perylenimide; squalium colorants; pyrilium salts and thiopyrilium salts; and triphenylmethane colorants.

In the present invention, the charge generation layer may be formed by dispersing the charge-generating material in an appropriate solution containing a binder resin and a solvent, applying the resultant coating liquid onto, e.g., the intermediate layer by using a known coating method and then drying the coating. The charge generation layer may preferably have a thickness of at most 5 μm, particularly 0.05–2 μm. Examples of the binder resin may include polyvinyl acetal, polystyrene, polyester, polyvinyl acetate, methacrylic resin, acrylic resin, polyvinyl pyrolidone and cellulosic resin.

The charge transport layer according to the present invention may generally be formed by dissolving the charge-transporting material in an appropriate solvent together with a binder resin, applying the resultant coating liquid such as solution onto a predetermined surface (e.g., the surface of the intermediate layer, charge generation layer, etc.) by coating, and then drying the resultant coating.

The charge-transporting material may generally be classified roughly into an electron-transporting material and a hole-transporting material.

Examples of the electron-transporting material may include: an electron acceptor such as 2,4,7-trinitrofluorenone, 2,4,5,7-tetranitrofluorenone, chloranil or tetracyanoquinone-dimethane; and polymerized these substances. Examples of the hole-transporting material may include: polycyclic aromatic compounds such as pyrene and anthracene; heterocyclic compounds such as carbazoles, indoles, imidazole, oxazoles, thiazoles, oxadiazoles, pyrazoles, pyrazolines, thiadiazoles and triazole; hydrazone compounds such as p-diethylamionobenz-aldehyde-N,N-diphenylhydrazone and N,N-diphenylhydrazino-3-methylidene-9-ethylcarbazole; styryl-type compounds such as α-phenyl-4'-N,N-diphenylaminostilbene and 5-[4-(di-p-tolylamino)-benzylidene]-5H-dibenzo-[a,d]-cycloheptene; benzidines; triarylamines; triphenylamine; and polymers having a group containing a group derived from the above-mentioned compounds at a main chain or a side chain, such as poly-N-vinylcarbazole and polyvinylanthracene.

Examples of the binder resin used for forming the charge transport layer may include polyester, polycarbonate, polymethacrylate and polystyrene. The charge transport layer may preferably have a thickness of 5–40 μm, particularly 10–30 μm.

In case where the photosensitive layer is composed of a single layer, the photosensitive layer may be formed by dispersing and dissolving the charge-generating material and the charge-transporting material respectively as described above in an appropriate solvent together with the binder resin as described above, applying the resultant coating liquid onto the intermediate layer by coating and then drying the coating.

The thickness of the single layer-type photosensitive layer may preferably be 5–40 microns, more preferably 10–30 microns.

The photosensitive layer used in the present invention may also be composed of an organic photoconductive polymer layer comprising polyvinylcarbazole or polyvinylanthracene; a vapor-deposited layer of the above-mentioned charge-generating material; selenium vapor-deposited layer; selenium-tellurium vapor-deposited layer; and amorphous silicon layer.

The electroconductive support used in the present invention may include aluminum, aluminum alloy, copper, zinc, stainless steel, titanium, nickel, indium, gold and platinum. The electroconductive support may also include: a plastic (such as polyethylene, polypropyrene, polyvinyl chloride, polyethylene terephthalate or acrylic resins) coated with, e.g., a vacuum vapor-deposited layer of the above-mentioned metal or alloy; a plastic, metal or alloy coated with a layer comprising a mixture of an electroconductive powder (such as carbon black or silver particles) and an appropriate binder resin; and a plastic or paper impregnated with electroconductive particles. The electroconductive support may be shaped in any form such as drum, sheet, film, belt, etc., and may preferably have a shape suitably adapted to an electrophotographic photosensitive member used.

In the present invention, in order to protect the photosensitive layer from external mechanical shock or external chemical action, a protective layer can further be disposed on the photosensitive layer. Such a protective layer may comprise a resin, or a resin containing electro-conductive particles.

In the present invention, examples of the coating method used for forming the respective layers (intermediate layer, photosensitive layer, protective layer) may include: dip coating, spray coating, beam coating, spin coating, roller coating, wire bar coating and blade coating.

The electrophotographic photosensitive member according to the present invention can be widely applied to not only an ordinary electrophotographic apparatus such as copying machine, a laser beam printer, a light-emitting diode (LED) printer, a liquid crystal shutter-type printer, but also other fields of applied electrophotography including, e.g., display, recording, light printing, plate making, and a facsimile machine.

FIG. 1 shows a schematic structural view of an electrophotographic apparatus including a process cartridge using an electrophotographic photosensitive member of the invention. Referring to FIG. 1, a photosensitive drum (i.e., photosensitive member) 1 as an image-carrying member is rotated about an axis 2 at a prescribed peripheral speed in the direction of the arrow shown inside of the photosensitive drum 1. The surface of the photosensitive drum is uniformly charged by means of a primary charger (charging means) 3 to have a prescribed positive or negative potential. The photosensitive drum 1 is exposed to light-image 4 (as by slit exposure or laser beam-scanning exposure) by using an image-exposure means (not shown), whereby an electrostatic latent image corresponding to an exposure image is successively formed on the surface of the photosensitive drum 1. The electrostatic latent image is developed by a developing means 5 to form a toner image. The toner image is successively transferred to a transfer material 7 which is supplied from a supply part (not shown) to a position between the photosensitive drum 1 and a transfer charger (transfer means) 6 in synchronism with the rotating speed of the photosensitive drum 1, by means of the transfer charger 6. The transfer material 7 with the toner image thereon is separated from the photosensitive drum 1 to be conveyed to a fixing device (image-fixing means) 8, followed by image fixing to print out the transfer material 7 as a copy product outside the electrophotographic apparatus. Residual toner particles on the surface of the photosensitive drum 1 after the transfer are removed by means of a cleaner (cleaning means) 9 to provide a cleaned surface, and residual charge on the surface of the photosensitive drum 1 is erased by a pre-exposure light 10 emitted from a pre-exposure means (not shown) to prepare for the next cycle. In case where the primary charging means 3 is a contact charging means such as a charging roller, the pre-exposure step may be omitted.

According to the present invention, in the electrophotographic apparatus, it is possible to provide a process cartridge 11 which includes plural means inclusive of or selected from the photosensitive member (photosensitive drum) 1, the charging means 3, the developing means 5, the cleaning means 9, etc. so as to be attached (or connected) to or detached (or released) from an apparatus main body of the electrophotographic apparatus such as a copying machine or a laser beam printer, as desired. The process cartridge 11 may, for example, be composed of the photosensitive member and at least one device of the charging means 3, the developing means 5 and the cleaning means 9 which are integrally supported and assembled to prepare a single unit as the process cartridge 11 which is detachably mountable to an electrophotographic apparatus main body by using a guiding means such as a rail 12 disposed within the apparatus main body.

In case where the electrophotographic apparatus is used as a copying machine or a printer, image-exposure light 4 may be given by reading data on reflection light or transmitted light from an original or by reading data on the original by a sensor, converting the data into a signal and then effecting a laser beam scanning, a drive of LED array or a drive of a liquid crystal shutter array so as to expose the photosensitive member to the light-image 4.

Figure 2:
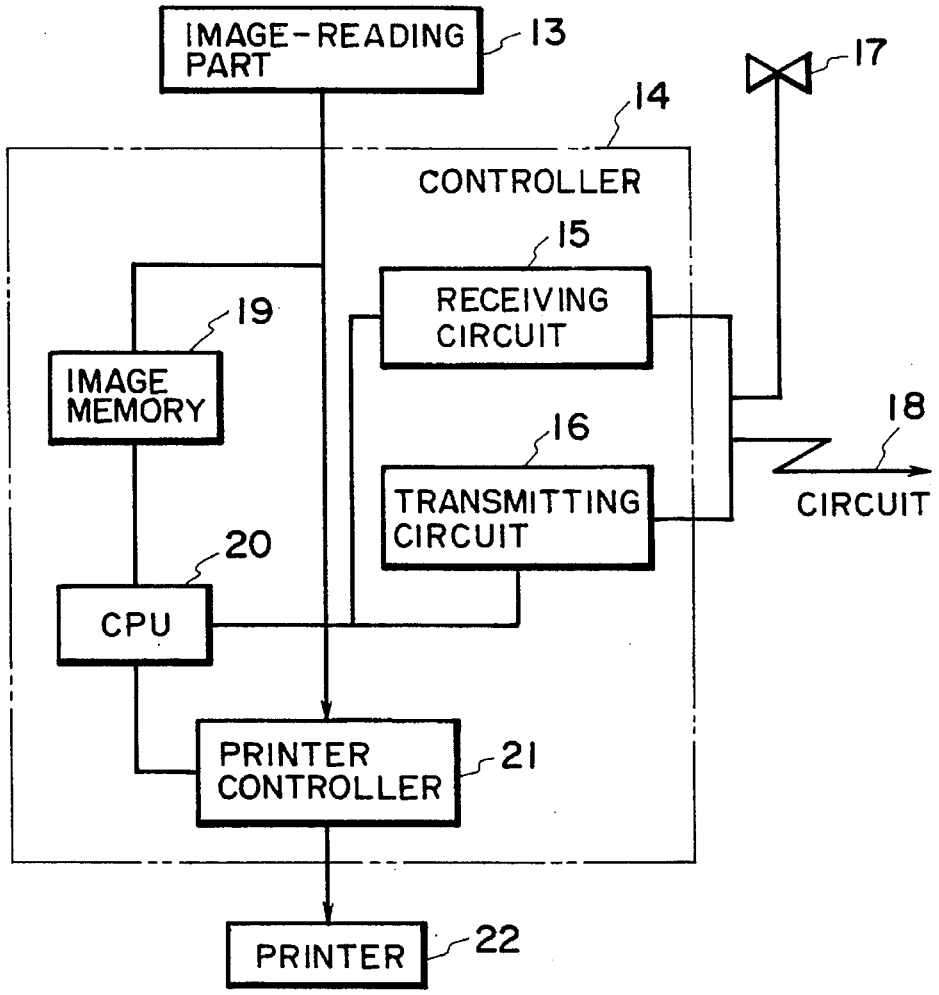
FIG. 2 is a block diagram of an embodiment of a facsimile machine using the electrophotographic apparatus according to the present invention.

In case where the electrophotographic apparatus according to the present invention is used as a printer of a facsimile machine, image-exposure light 4 is given by exposure for printing received data. FIG. 2 shows a block diagram of an embodiment for explaining this case. Referring to FIG. 2, a controller 14 controls an image-reading part 13 and a printer 22. The whole controller 14 is controlled by a CPU (central processing unit) 20. Read data from the image-reading part 13 is transmitted to a partner station through a transmitting circuit 16, and on the other hand, the received data from the partner station is sent to the printer 22 through a receiving circuit 15. An image memory memorizes prescribed image data. A printer controller 21 controls the printer 22, and a reference numeral 17 denotes a telephone handset.

The image received through a circuit 18 (the image data sent through the circuit from a connected remote terminal) is demodulated by means of the receiving circuit 15 and successively stored in an image memory 19 after a restoring-signal processing of the image data. When image for at least one page is stored in the image memory 19, image recording of the page is effected. The CPU 20 reads out the image data for one page from the image memory 19 and sends the image data for one page subjected to the restoring-signal processing to the printer controller 21. The printer controller 21 receives the image data for one page from the CPU 20 and controls the printer 22 in order to effect image-data recording. Further, the CPU 20 is caused to receive image for a subsequent page during the recording by the printer 22. As described above, the receiving and recording of the image are performed.

Hereinbelow, the present invention will be explained more specifically with reference to examples, to which the present invention is however not restricted.

In the following examples "part(s)" means "weight part(s)".

EXAMPLE 1

Onto an aluminum cylinder (outer diameter=30 mm, length=254 mm), a solution of 5 parts of a copolymer having a recurring unit comprising an amide acid structure (Ex. Comp. No. 3) (number-average molecular weight (Mn) of 10,000) in 95 parts of tetrahydrofuran (THF) was applied by dip coating and left standing for 10 minutes at room temperature, followed by drying at 160° C. for 30 minutes to form a 1 μm-thick intermediate layer. Separately, a copolymer layer was prepared in the same manner as in the above intermediate layer and subjected to measurement of infrared (IR) absorption spectrum described above, whereby the resin was found to have an imide degree of 42 mole %.

Then, 4 parts of an oxytitaniumphthalocyanine pigment of the following formula:

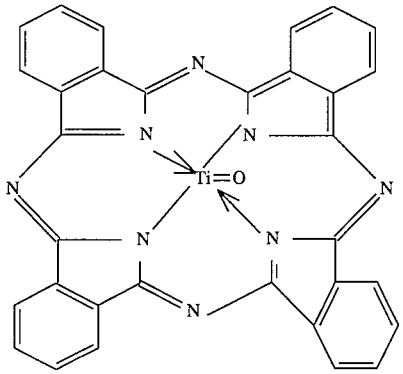

was added to a solution of 2 parts of polyvinyl butyral ("BX-1", mfd. by Sekisui Kagaku Kogyo K.K.) in 34 parts of cyclohexanone, followed by stirring for 8 hours in a sand mill. To the mixture, 60 parts of THF was added to prepare a coating liquid for a charge generation layer. The coating liquid was applied onto the above-prepared intermediate layer, followed by drying to form a 0.2 μm-thick charge generation layer.

Then, 5 parts of a triarylamine compound of the following formula:

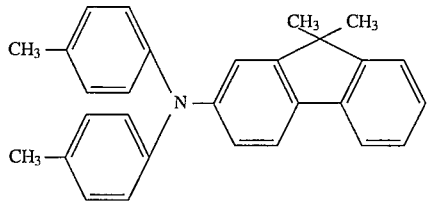

and 5 g of polycarbonate ("Z-200", mfd. by Mitsubishi Gas Kagaku K.K.) were dissolved in 40 g of monochlorobenzene to prepare a coating liquid.

The coating liquid was applied onto the above-prepared charge generation layer by dipping, followed by drying for 30 minutes to form a 15 μm-thick charge transport layer, whereby an electrophotographic photosensitive member was prepared.

The thus-prepared photosensitive member was incorporated in a laser beam printer, of reversal development system, performing processes of charging-exposure-development-transfer-cleaning at a rate of 1.5 sec/cycle and was then subjected to image formation of 5,000 sheets (durability test) under high-temperature and high-humidity environmental condition (30° C., 85% RH) to evaluate electrophotographic characteristics. More specifically, in order to evaluate the electrophotographic characteristics, a dark-part potential ($V_D$) at an initial stage and light-part potential ($V_L$) at the initial stage and after the durability test (after copying of 5,000 sheets) were measured and a resultant image was subjected to eye (visual) observation.

The results are shown in Table 1 appearing hereinafter.

EXAMPLES 2–10

Photosensitive members were prepared and evaluated in the same manner as in Example 1 except that copolymer having respective recurring units comprising an amide acid structure and/or an amide acid ester structure (Ex. Comp. Nos. 4, 8, 12, 15, 20, 21, 25, 30 and 32) were used instead of the copolymer having a recurring unit (Ex. Comp. No. 3), respectively. The results are also shown in Table 1.

COMPARATIVE EXAMPLE 1

A photosensitive member was prepared and evaluated in the same manner as in Example 1 except that an intermediate layer was formed by using a solution of 5 parts of alcohol-soluble copolymer nylon ("Amilan CM-8000", mfd. by Toray K.K.) in 95 parts of methanol was used. The results are shown in Table 1.

COMPARATIVE EXAMPLE 2

A photosensitive member was prepared and evaluated in the same manner as in Example 1 except that an intermediate layer was formed by applying a solution of 10 parts of zirconium tetracetylacetonate ("ZC150", mfd. by Matsumoto Kosho K.K.) and 20 parts of v-methacryloxypropyltrimethoxysilane ("KBM 503", mfd. by Shinetsu Kagaku K.K.) in a mixture solvent composed of 400 parts of methanol, 100 parts of n-butanol and 200 parts of n-amyl alcohol and drying a resultant coating at 155° C. for 120 minutes. The results are shown in Table 1.

COMPARATIVE EXAMPLE 3

A photosensitive member was prepared and evaluated in the same manner as in Example 1 except that an intermediate layer was formed by using a copolymer having a recurring unit comprising an amide acid structure shown below:

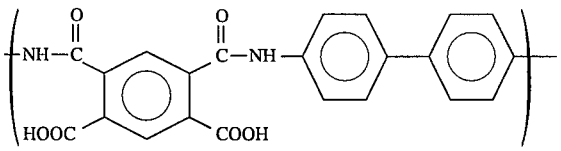

instead of the copolymer (Ex. Comp. No. 3) and using dimethylformamide instead of THF. The results are shown in Table 1.

COMPARATIVE EXAMPLE 4

A photosensitive member was prepared and evaluated in the same manner as in Example 1 except that the intermediate layer was prepared by performing drying at 100° C. for 60 minutes and heat treatment at 250° C. for 3 hours. As a result of measurement of infrared (IR) absorption spectrum, the entire amide acid structure in the copolymer was completely changed to the corresponding imide structure. The results are shown in Table 1 below.

TABLE 1

| | Initial stage | | After durability test | | Image degree |
|---|---|---|---|---|---|
| Ex. No. | $V_D$ (–V) | $V_L$ (–V) | $V_L$ (–V) | Image | (mole %) |
| Ex. 1 | 651 | 151 | 147 | Good | 42 |
| 2 | 649 | 143 | 141 | " | 58 |
| 3 | 648 | 145 | 142 | " | 55 |

TABLE 1-continued

| | Initial stage | | After durability test | | Image degree |
|---|---|---|---|---|---|
| Ex. No. | $V_D$ (–V) | $V_L$ (–V) | $V_L$ (–V) | Image | (mole %) |
| 4 | 652 | 153 | 150 | " | 43 |
| 5 | 650 | 150 | 145 | " | 55 |
| 6 | 648 | 149 | 147 | " | 57 |
| 7 | 648 | 152 | 149 | " | 55 |
| 8 | 652 | 147 | 145 | " | 49 |
| 9 | 649 | 151 | 148 | " | 50 |
| 10 | 651 | 151 | 149 | " | 51 |
| Comp. Ex. 1 | 650 | 142 | 169 | Black spot | — |
| 2 | 649 | 153 | 178 | Black spot | — |
| 3 | 649 | 148 | 166 | Poor image density | 47 |
| 4 | 655 | 155 | 172 | Poor image density | 100 |

EXAMPLE 11

Onto an aluminum cylinder identical to that used in Example 1, a coating liquid formed by dispersing a mixture of 25 parts of resol-type phenolic resin ("Pli-O-phen J-325", mfd. by Dainippon Ink and Chemicals, Inc.), 50 parts of electroconductive titanium oxide powder coated with tin oxide containing antimony oxide (antimony content=10%), 25 parts of ethylene glycol monomethyl ether (methyl cellosolve) and 5 parts of methanol, for 20 hours in a sand mill was applied and dried to form a 10 μm-thick first intermediate layer.

Then, a 0.5 μm-thick second intermediate layer was formed on the above first intermediate layer in the same manner as in the intermediate layer formed in Example 2.

When the thus-prepared sample cylinder was subjected to observation through an optical microscope, a smooth coating surface free from occurrence of a crack was confirmed.

COMPARATIVE EXAMPLES 5 AND 6

Sample cylinders were prepared and evaluated in the same manner as in Example 11 except that second intermediate layers were formed in the same manners as in Comparative Examples 2 and 3, respectively.

In either case, a crack visible to the maked eye was observed in the first intermediate layer after the application of the second intermediate layer.

EXAMPLE 12

A photosensitive member was prepared in the same manner as in Example 1 except that a coating liquid for an intermediate layer was applied onto an aluminum cylinder (outer diameter=30 mm, length=360 mm) and dried at 170° C. for 10 minutes to form a 1.2 μm-thick intermediate layer and that a charge generation layer was formed in the following manner.

To 5 parts of a disazo pigment of the following formula:

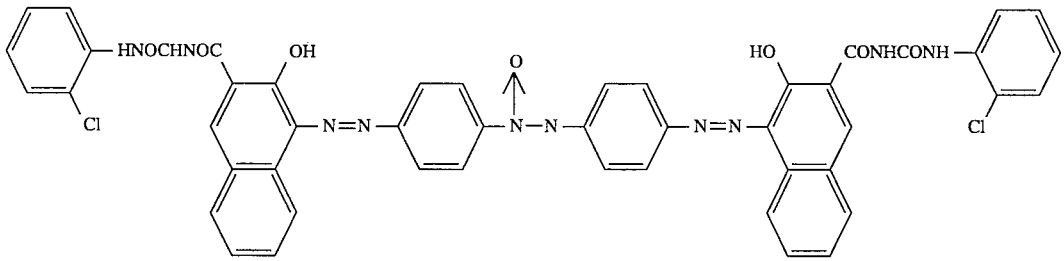

90 parts of THF was added, followed by stirring for 20 hours in a sand mill. To the dispersion, a solution of 2.5 parts of butyral resin ("BLS", manufactured by Sekisui Kagaku Kogyo K.K.) in 20 parts of THF was added, followed by stirring for 2 hours. The resultant dispersion was diluted with 100 parts of cyclohexanone and 80 parts of THF to prepare a coating liquid. The coating liquid was applied onto the above-prepared intermediate layer by dip coating, followed by drying for 5 minutes to form a 0.28 μm-thick charge generation layer.

The thus-prepared photosensitive member was installed in a plain paper copying machine, of normal development system, performing processes of charging-exposure-development-transfer-cleaning at a rate of 0.8 sec/cycle and was then subjected to image formation of 10,000 sheets (durability test) under low-temperature and low-humidity environmental condition (15° C., 15% RH) to evaluate electrophotographic characteristics. More specifically, in order to evaluate the electrophotographic characteristics, a dark-part potential ($V_D$) at an initial stage and light-part potential ($V_L$) at the initial stage and after the durability test (after copying of 10,000 sheets) were measured and a resultant image was subjected to eye observation.

The results are shown in Table 2 appearing hereinafter.

EXAMPLES 13–21

Photosensitive members were prepared and evaluated in the same manner as in Example 12 except that each of the coating liquids for the intermediate layers prepared in Examples 2–10 (corresponding to Examples 13–21, respectively) was used. The results are shown in Table 2.

COMPARATIVE EXAMPLES 7–10

Photosensitive members were prepared and evaluated in the same manner as in Example 12 except that the coating liquids for the intermediate layers prepared in Comparative Examples 1–4 (corr. to Comparative Examples 7–10, respectively) was used. The results are shown in Table 2 below.

TABLE 2

| | Initial stage | | After durability test | |
|---|---|---|---|---|
| Ex. No. | $V_D$ (–V) | $V_L$ (–V) | $V_L$ (–V) | Image |
| Ex. 12 | 685 | 180 | 180 | Good |
| 13 | 672 | 200 | 203 | " |
| 14 | 697 | 185 | 187 | " |
| 15 | 682 | 192 | 197 | " |
| 16 | 673 | 203 | 204 | " |
| 17 | 677 | 187 | 189 | " |
| 18 | 697 | 210 | 210 | " |
| 19 | 691 | 215 | 217 | " |
| 20 | 680 | 193 | 194 | " |
| 21 | 677 | 186 | 190 | " |

TABLE 2-continued

| | Initial stage | | After durability test | |
|---|---|---|---|---|
| Ex. No. | $V_D$ (–V) | $V_L$ (–V) | $V_L$ (–V) | Image |
| Comp. Ex. 7 | 690 | 190 | 249 | Fog |
| 8 | 686 | 199 | 265 | " |
| 9 | 680 | 198 | 250 | " |
| 10 | 699 | 194 | 259 | " |

What is claimed is:

1. An electrophotographic photosensitive member, comprising: an electroconductive support, an intermediate layer disposed on the electroconductive support and a photosensitive layer disposed on the intermediate layer, wherein the intermediate layer comprises a copolymer having at least two species of a recurring unit having an amide acid structure or an amide acid ester structure.

2. A member according to claim 1, wherein said amide acid structure and said amide acid ester structure are represented by the following formula (1):

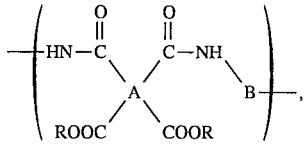

(1)

wherein A is a tetravalent organic group, B is a divalent organic group, and R is hydrogen atom or alkyl group.

3. A member according to claim 1, wherein said photosensitive layer comprises a charge generation layer and a charge transport layer.

4. A member according to claim 3, wherein said electroconductive support, said intermediate layer, said charge generation layer and said charge transport layer are disposed in this order.

5. A process cartridge, comprising: an electrophotographic photosensitive member according to claim 1 and at least one means selected from charging means, developing means, and cleaning means;

wherein said photosensitive member, and said at least one means selected from charging means, developing means, and cleaning means are integrally supported to form a cartridge which is detachably mountable to an electrophotographic apparatus main body.

6. A cartridge according to claim 5, wherein said amide acid structure and said amide acid ester structure are represented by the following formula (1):

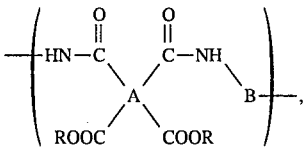

(1)

wherein A is a tetravalent organic group, B is a divalent organic group, and R is hydrogen atom or alkyl group.

7. An electrophotographic apparatus, comprising: an electrophotographic photosensitive member according to claim 1, charging means, image-exposure means, developing means and transfer means.

8. An apparatus according to claim 7, wherein said amide acid structure and said amide acid ester structure are represented by the following formula (1):

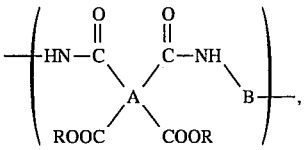

(1)

wherein A is a tetravalent organic group, B is a divalent organic group, and R is hydrogen atom or alkyl group.

* * * * *

UNITED STATES PATENT AND TRADEMARK OFFICE

CERTIFICATE OF CORRECTION

PATENT NO. : 5,604,061

DATED : February 18, 1997

INVENTOR(S) : KUNIHIRO SEKIDO ET AL.

It is certified that error appears in the above-indentified patent and that said Letters Patent is hereby corrected as shown below:

ON TITLE PAGE

[56] References Cited "2115858" should read --2-115858--.

COLUMN 1

Line 19, "encountered" should read --encounter--.

COLUMN 2

Line 17, "an" should read --a--.

COLUMN 6

Line 38, "(R'=alkyl)" should read --(R'=alkyl));
Line 64, "are" should read --is--.

COLUMN 11

Ex. Comp. No. 12 "O" should read --O--

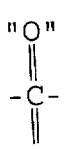

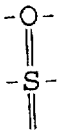

UNITED STATES PATENT AND TRADEMARK OFFICE

CERTIFICATE OF CORRECTION

PATENT NO. : 5,604,061

DATED : February 18, 1997

INVENTOR(S) : KUNIHIKO SEKIDO ET AL.

It is certified that error appears in the above-indentified patent and that said Letters Patent is hereby corrected as shown below:

COLUMN 19

Ex. Comp. No. 26 "O" should read --O--

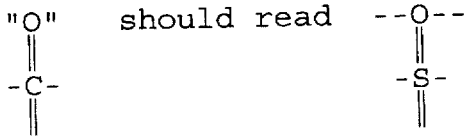

COLUMN 24

Line 21, "sulfide" should read --sulfides--.

COLUMN 25

Line 9, "pyrolidone" should read --pyrrolidone--;
Line 24, "polymerized these" should read --polymers of these--.

COLUMN 26

Line 62, "case" should read --the case--.

COLUMN 27

Line 16, "case" should read --the case--;
Line 24, "case" should read --the case--.

UNITED STATES PATENT AND TRADEMARK OFFICE

CERTIFICATE OF CORRECTION

PATENT NO. : 5,604,061

DATED : February 18, 1997

INVENTOR(S) : KUNIHIKO SEKIDO ET AL.

It is certified that error appears in the above-indentified patent and that said Letters Patent is hereby corrected as shown below:

COLUMN 29

Line 24, "v-methacryloxypropylt-" should read --y-methacryloxypropylt- --.

COLUMN 30

Line 51, "maked" should read --naked--.

Signed and Sealed this

Twenty-third Day of September, 1997

Bruce Lehman

*Attest:*

BRUCE LEHMAN

*Attesting Officer*

*Commissioner of Patents and Trademarks*